US008388871B2

(12) United States Patent
Kato et al.

(10) Patent No.: US 8,388,871 B2
(45) Date of Patent: Mar. 5, 2013

(54) TRANSLUCENT CONDUCTIVE FILM FORMING COATING LIQUID, TRANSLUCENT CONDUCTIVE FILM, AND DISPERSIVE TYPE ELECTROLUMINESCENT DEVICE

(75) Inventors: Kenji Kato, Ichikawa (JP); Masaya Yukinobu, Ichikawa (JP)

(73) Assignee: Sumitomo Metal Mining Co., Ltd., Tokyo (JP)

( * ) Notice: Subject to any disclaimer, the term of this patent is extended or adjusted under 35 U.S.C. 154(b) by 0 days.

(21) Appl. No.: 11/783,107

(22) Filed: Apr. 5, 2007

(65) Prior Publication Data

US 2007/0237944 A1 Oct. 11, 2007

(30) Foreign Application Priority Data

Apr. 7, 2006 (JP) ..... 2006-106100
Apr. 2, 2007 (JP) ..... 2007-096732

(51) Int. Cl.
*H01B 1/12* (2006.01)

(52) U.S. Cl. ..... 252/519.33; 252/511; 252/518.1; 313/506; 313/509; 313/511; 427/66; 427/386; 428/328; 428/329; 428/402; 428/609; 524/430; 524/432

(58) Field of Classification Search ..... 252/500, 252/519.3, 511, 518.1, 519.33; 428/1.3, 428/292.1, 697, 402, 690, 328, 329; 524/108, 524/430, 432; 136/256; 427/123, 386, 66; 523/161; 313/509, 506, 511
See application file for complete search history.

(56) References Cited

U.S. PATENT DOCUMENTS

| | | | | |
|---|---|---|---|---|
| 4,529,885 | A * | 7/1985 | Waite et al. | 313/509 |
| 5,213,846 | A * | 5/1993 | Tsuneta et al. | 427/386 |
| 5,395,869 | A * | 3/1995 | Kawamoto et al. | 524/108 |
| 5,529,720 | A * | 6/1996 | Hayashi et al. | 252/519.3 |
| 6,084,007 | A * | 7/2000 | Narukawa et al. | 523/161 |
| 6,200,680 | B1 * | 3/2001 | Takeda et al. | 428/402 |
| 6,261,633 | B1 * | 7/2001 | Burrows | 427/123 |
| 6,500,891 | B1 * | 12/2002 | Kropp et al. | 524/430 |
| 2001/0017153 | A1 * | 8/2001 | Kubota et al. | 136/256 |
| 2003/0017371 | A1 * | 1/2003 | Burrows et al. | 428/697 |
| 2003/0030036 | A1 * | 2/2003 | Inamura et al. | 252/500 |
| 2003/0143429 | A1 * | 7/2003 | Suzuki et al. | 428/690 |
| 2006/0182941 | A1 * | 8/2006 | Yano et al. | 428/292.1 |
| 2007/0004840 | A1 * | 1/2007 | Miyatake et al. | 524/432 |
| 2007/0172604 | A1 * | 7/2007 | Sugiyama et al. | 428/1.3 |

FOREIGN PATENT DOCUMENTS

| | | | |
|---|---|---|---|
| JP | 56120519 | | 9/1981 |
| JP | 62003003 | | 1/1987 |
| JP | 63-270128 | * | 11/1988 |
| JP | 05-301312 | * | 11/1993 |
| JP | 06-080422 | * | 3/1994 |
| JP | 06293515 | | 10/1994 |
| JP | 06-309922 | * | 11/1994 |
| JP | 06309922 | | 11/1994 |
| JP | 08-078164 | * | 3/1996 |
| JP | 08-302246 | * | 11/1996 |
| JP | 09035873 | | 2/1997 |
| JP | 11-043556 | * | 2/1999 |
| JP | 11-273874 | * | 10/1999 |
| JP | 11273874 | | 10/1999 |
| JP | 2003-296031 | * | 10/2003 |
| WO | WO 2005/078486 | * | 8/2005 |

OTHER PUBLICATIONS

English Abstract of 62-003003.
English Abstract of 56-120519.
English Abstract of 06-293515.
English Abstract of 06-309922.
English Abstract of 09-035873.
English Abstract of 11-273874.

* cited by examiner

*Primary Examiner* — Khanh Tuan Nguyen
(74) *Attorney, Agent, or Firm* — Dykema Gossett PLLC

(57) ABSTRACT

A translucent conductive film-forming coating liquid that can form a translucent conductive film having excellent translucency and conductivity together with organic solvent resistance includes conductive oxide acicular powder dispersed in a solvent containing a binder resin, the glass transition point (Tg) of the binder resin being 120° C. or more.

10 Claims, No Drawings

TRANSLUCENT CONDUCTIVE FILM FORMING COATING LIQUID, TRANSLUCENT CONDUCTIVE FILM, AND DISPERSIVE TYPE ELECTROLUMINESCENT DEVICE

BACKGROUND OF THE INVENTION

1. Field of the Invention

The present invention relates to translucent conductive film-forming coating liquids applied for forming, for example, transparent electrodes of a dispersive type electroluminescent device (hereinafter, sometimes abbreviated as a dispersive type EL device); especially, the translucent conductive film-forming coating liquids having excellent translucency and conductivity, as well as the ability to resist the deterioration of film characteristics such as a resistance value during the EL device production process; translucent conductive film obtained from the translucent conductive film-forming coating liquids; and dispersive type electroluminescent devices which use the translucent conductive film for their transparent electrodes.

2. Description of the Related Art

A dispersive type EL device is a light emitting device driven by alternating voltage, and has so far been used for the back light of liquid crystal displays of a cellular phone and a remote controller, and the like. In recent years, it has been applied to the light-emitting sheet incorporated in the key input part (keypad) of a cellular phone and the like, taking advantage of the thinness (about 0.1 millimeter thick), the flexibility, the in-plane homogeneity of luminance, variety of luminescent colors, low power consumption, and the like.

Generally, the transparent conductive film applied to the transparent electrodes of the dispersive type EL device and the like is formed by an application method using the transparent conductive film-forming coating liquid which contains conductive filler dispersed in a solvent containing a binder.

As the conductive fillers used for such transparent conductive film-forming coating liquids, there are, conventionally, oxide type fillers, such as an indium-tin oxide (hereinafter also called "ITO") and an antimony-tin oxide (hereinafter also called "ATO"). and ITO is especially used widely, since its resistance value is lower than ATO and the like.

By the way, the smaller the content of the conductive filler used in the above-mentioned transparent conductive film-forming coating liquid, the more preferable. This is because the optical absorption of the conductive oxide, the conductive filler, is by far larger than that of the binder consisting of transparent resin, one of the coating components.

Accordingly, the visible light transmittance of the film will be increased by reducing the amount of the conductive oxide filler relative to the binder to be as small as possible, within the range that a conductive film with a low resistance value can be obtained.

Due to these reasons, the film with a lower resistance value is advantageously obtained by addition of smaller amount of acicular or scaly conductive filler than spherical or granular conductive filler.

As a method for obtaining the above scaly oxide powder, for example, according to the description of Patent document 1, there is a procedure that, after freezing a colloidal dispersion liquid of an inorganic oxide fine particle, a hydrated inorganic oxide fine particle or the like, and allowing inorganic oxide fine particles or hydrated oxide fine particles to deposit in the gaps between the crystal faces of the solvent of the colloidal dispersion liquid, the fine particles are dried to remove the solvent, and further calcinated in the case of the hydrated oxide fine particles.

As methods for obtaining the above acicular oxide powder, for example, a procedure according to the indication of Patent document 2 of thermally decomposing acicular tin oxalate to obtain acicular tin oxide, or a procedure according to the indication of Patent document 3 of thermally decomposing white acicular indium compound powder recovered from the concentrated slurry of indium nitrate solution heated at high temperature, to obtain acicular indium-tin oxide, have been known.

As a conductive film-forming coating liquid that uses the above-mentioned conductive filler, a paste using acicular ITO powder has been known, as indicated such as in Patent documents 4 to 6. Since a conductive film-formed by using the conductive film-forming coating liquid containing such conductive oxide acicular powder has a higher haze value (large scattering rate) than the so-called transparent conductive film, it is called a translucent conductive film.

The above-mentioned translucent conductive film is not transparent but has excellent translucency with small light-absorption, and thus is applicable enough as transparent electrodes of the dispersive type EL device and the like.

However, when the (translucent) conductive film-forming coating liquid (paste) adopting the conventional binder resin according to the descriptions of the above Patent documents 4 to 6, was going to be used as the transparent electrode of the dispersive type EL device, the following problem turned out to occur: if a phosphor layer, a dielectric layer, or the like is lamination-printed on the above-mentioned translucent conductive film, during the production process of the EL device the film characteristics (the resistance value, and the like) of the translucent conductive film deteriorates.

Patent document 1: Laid-open Japanese patent publication No. S62-3003,

Patent document 2: Laid-open Japanese patent publication No. S56-120519,

Patent document 3: Laid-open Japanese patent publication No. H6-293515,

Patent document 4: Laid-open Japanese patent publication No. H6-309922,

Patent document 5: Laid-open Japanese patent publication No. H9-35873,

Patent document 6: Laid-open Japanese patent publication No. H11-273874.

SUMMARY OF THE INVENTION

Problems to be Solved by the Invention

The present invention was made in view of above-mentioned conventional problem, and is directed to a translucent conductive film-forming coating liquid used for formation of a translucent conductive film useful as transparent electrodes of the dispersive type EL device. The present invention intends to offer: a translucent conductive film-forming coating liquid which is not only excellent in translucency and conductivity, but also can suppress deterioration of film characteristics, such as a resistance value, in an EL device production process; a translucent conductive film formed using the translucent conductive film-forming coating liquid; and a dispersive type electroluminescent device which uses the translucent conductive film for the transparent electrode.

Means for Solving the Problems

The present inventors have studied eagerly about the binder used for translucent conductive film-forming coating liquid in order to improve the organic solvent resistance of the translucent conductive film, and have found out the following: suppression of deterioration of film characteristics such as the resistance value of the translucent conductive film in the production process of the EL device is possible when a resin with a glass transition point (Tg) of 120° C. or higher is applied.

Namely, in order to achieve the above-mentioned object, the 1st embodiment of the present invention is a translucent conductive film-forming coating liquid including conductive oxide acicular powder dispersed in a solvent containing a binder resin, wherein the glass transition point (Tg) of the binder resin is 120° C. or higher.

The 2nd embodiment of the present invention is a translucent conductive film forming coating liquid according to the $1^{st}$ embodiment, wherein the glass transition point (Tg) of the binder resin is 140° C. or higher.

The 3rd embodiment of the present invention is the translucent conductive film-forming coating liquid according to the 1st or the 2nd aspect, wherein the binder resin is a crosslinkable resin, and said solvent further contains a curing agent.

The 4th embodiment of the present invention is the translucent conductive film-forming coating liquid according to the 1st to the 3rd embodiments, wherein the binder resin is at least one kind of resin selected from phenoxy resin, cycloolefin resin, and sulfone resin.

The 5th embodiment of the present invention is the translucent conductive film-forming coating liquid according to the $4^{th}$ embodiment, wherein the skeleton of the phenoxy resin further contains phosphorus and/or sulfur.

The 6th embodiment of the present invention is the translucent conductive film-forming coating liquid according to the 3rd embodiment, wherein the curing agent is blocked isocyanate.

The 7th embodiment of the present invention is the translucent conductive film-forming coating liquid according to any one of the 1st to the 6th embodiments, wherein the conductive oxide acicular powder is mainly composed of any of metallic oxides selected from indium oxide, tin oxide, and zinc oxide.

The 8th embodiment of the present invention is the translucent conductive film-forming coating liquid according to any one of the 1st to the 7th embodiments, wherein the conductive oxide acicular powder is indium oxide doped with at least one metallic oxide selected from tin oxide, zirconium oxide, zinc oxide, tungsten oxide, and titanium oxide.

The 9th embodiment of the present invention is the translucent conductive film-forming coating liquid according to any one of the 1st to the $9^{th}$ embodiments, wherein the average aspect ratio of the conductive oxide acicular powder is five or more.

The 10th embodiment of the present invention is the translucent conductive film-forming coating liquid according to any one of the 1st to the 8th embodiments, wherein the conductive oxide acicular powder is the one with an average length of 5 to 20 micrometers obtained by crushing the conductive oxide acicular powder with the average length of 25 micrometers or more and with the average aspect ratio of five or more.

The 11th embodiment of the present invention is the translucent conductive film-forming coating liquid according to any one of the 1st to the 10th embodiments, wherein the weight ratio, (conductive-oxide acicular powder: binder), is (40:60) to (90: 10).

The 12th embodiment of the present invention is a translucent conductive film-formed using the translucent conductive film-forming coating liquid according to any one of the 1st to the $11^{th}$ embodiments, wherein the film specific resistance thereof is 5.0Ω·cm or less.

The 13th invention of the present invention is a dispersive type electroluminescent device, wherein the translucent conductive film according to the 12th invention is used for the transparent electrode.

Effect of the Invention

The present invention can provide a translucent conductive film which has high translucency and outstanding conductivity, and in parallel, when applied as a transparent electrode of the dispersive type EL device and the like, can suppress deterioration of the film characteristics such as the resistance value during the production process of the dispersive type EL device; and the translucent conductive coating liquid that can form the above film.

The translucent conductive film-forming coating liquid according to the present invention contains conductive oxide acicular powder, binder resin, and a solvent as main components. Especially, the binder resin component has the roles of connecting fine particles of the conductive oxide powder with each other to enhance the conductivity and strength of the translucent conductive film, and enhancing adhesion between the substrate and the translucent conductive film. Moreover, since the glass transition point of the binder resin is 120° C. or higher, deterioration of the above-mentioned translucent conductive film can be prevented when other films are formed by lamination-printing on the translucent conductive film during the production process of various devices (for example, the EL device).

The reason is not clear why the resistance increase of the translucent conductive film caused by the lamination-printing of a phosphor layer or an dielectric layer, etc., on the translucent conductive film is suppressed, for example, during the production process of the EL device, when the glass transition point of the above-mentioned binder resin is raised to 120° C. or higher. But it can be considered as follows, for example.

When a phosphor layer, an dielectric layer or the like is further lamination-printed on the translucent conductive film, heat-treatment will be performed in each lamination-printing process. If the glass transition point of the binder resin of the translucent conducting film is high, the translucent conductive film will not become soft at this occasion and will be less subject to the influence from each lamination-printed film.

As the binder resin with the above-mentioned high Tg, phenoxy resin, cycloolefin resin, sulfone resin are listed, for example.

Specifically, phenoxy resin is thermoplastic resin having hydroxyl groups in the molecular chain obtained by the condensation reaction between various bisphenol compounds and epichlorohydrin. The above-mentioned bisphenol compound includes, for example, bisphenol A [2,2-bis(4'-hydroxyphenyl)propane], bisphenol B [2,2-bis(4'-hydroxyphenyl) butane], bisphenol C [2,2-bis(3'-methyl-4'-hydroxyphenyl) propane], bisphenol D [bis(4-hydroxyphenyl)methane], bisphenol E (4,4'-dihydroxybiphenyl), bisphenol F (3,3'-n-propyl-4,4'-dihydroxybiphenyl). Especially, bisphenol A and bisphenol F are preferable. Said bisphenol compounds can be used independently, or by mixing two or more kinds of them. Elements, such as halogen, phosphorus, and sulfur, may be added to modify the phenoxy resin in order to improve the heat-resistance properties and the like. The phenoxy resin, which contains phosphorus and sulfur in its skeleton, is preferable, and especially the phenoxy resin containing phosphorus in the skeleton is preferable, because it can realize high Tg, and effectively suppresses deterioration of the translucent conductive film upon above-mentioned lamination-printing.

Here, the phenoxy resin that contains elements, such as phosphorus and sulfur in the side chains, instead of in the skeleton thereof, in the form of phosphoric acid, sulfonic acid, or the like, is not preferable, because not only the heat-resistance of the phenoxy resin cannot be improved, but also the translucent conductive film may be deteriorated by acid components such as phosphoric acid and sulfonic acid. On the other hand, the phenoxy resin that contains elements such as phosphorus and sulfur in the skeleton is preferable because there is no generation of acid components, such as phosphoric acid and sulfonic acid mentioned above, and heat-resistance of the phenoxy resin can be improved.

Cycloolefin resins mean resins of polymerized or copolymerized cyclic olefins, and include, for example, ring-opening polymers of norbornene monomers and their hydrogen additives, addition polymers of norbornene monomers, and copolymers of norbornene monomers and other monomers.

The sulfone resin includes polyether sulfone (PES), polysulfone and the like.

Among them, crosslinkable resins such as the phenoxy resin are preferable, since heat crosslink formation by curing agent, such as isocyanate, is possible and so their film characteristics, such as film strength and organic solvent resistance can be improved, if they are used together with a curing agent, if necessary.

As the above-mentioned curing agent, used are amino resins having amino groups and methylol groups, polyisocyanate, and the like, capable of forming crosslinks with hydroxyl groups. Here, polyisocyanates include, according to the raw material isocyanates used, polyisocyanates based on aromatic isocyanates, such as TDI (tolylene diisocyanate), MDI (diphenylmethane diisocyanate), XDI (xylylene diisocyanate), NDI (naphthylene 1,5-diisocyanate), TMXDI (tetramethylene xylylene diisocyanate); those based on alicyclic isocyanate, such as, IPDI (isophorone diisocyanate), H12MDI (Hydrogenated MDI, dicyclohexylmethane diisocyanate), H6XDI (hydrogenated XDI); and those based on aliphatic isocyanates, such as, HDI (hexamethylene diisocyanate), DDI (dimer acid diisocyanate), NBDI (norbornene diisocyanate).

Among these curing agents, those based on the aromatic isocyanates, such as TDI and MDI, generally turn yellow easily by ultraviolet irradiation, but those based on alicyclic isocyanates and aliphatic isocyanates, such as IPDI and HDI do not easily turn yellow, and are preferable. Among the isocyanate curing agents, the blocked isocyanates, which are polyisocyanates protected by the blocking agent, is especially preferable, because its crosslinking reaction is inhibited at low temperature, and thus it can be formed into all-in-one liquid type wherein the curing agent is beforehand blended with the coating liquid, instead of two liquids type wherein the curing agent is mixed with the coating liquid just before use. Among the blocked isocyanates, the aliphatic blocked isocyanates are preferable, since it does not turn yellow, and furthermore, HDI based blocked isocyanates whose lowest curing temperature (the temperature at which the protective action of the blocking agent decreases and a curing agent functions effectively as a curing agent) is 100° C. or less, Duranate MF-K 60X (Trade name) by Asahi Kasei Corporation for example, is especially preferable. Here, the proportion (mole ratio) of the hydroxyl group (—OH) of above-mentioned crosslinkable resin having hydroxyl groups, to the isocyanate group (—NCO) of the polyisocyanate is set arbitrarily by taking into account the characteristics of the crosslinkable resin, such as solvent resistance, strength and the like.

Together with the above-mentioned curing agent, conventional curing catalysts (dibutyl tin dilaurate, and the like) can also be used, if needed. Depending on the kinds of curing agents, the cure rate of the crosslinkable resin can be largely raised by using a curing catalyst together.

As the conductive oxide acicular powder in the translucent conductive film-forming coating liquid, the one mainly composed of any of metallic oxides selected from indium oxide, tin oxide, and zinc oxide has to be used.

More specifically, for example, indium oxide doped with at least one kind of metallic oxide selected from tin oxide, zirconium oxide, zinc oxide, tungsten oxide, and titanium oxide, tin oxide doped with fluorine and/or antimony oxide, and zinc oxide doped with aluminum oxide and/or gallium oxide, are desirable. Especially, acicular indium-tin oxide (ITO), indium oxide doped with tin oxide, having excellent translucency and conductivity, is preferable-as the-conductive oxide acicular powder.

The average aspect ratio (ratio of the length to the width) of the conductive oxide acicular powder is preferably five or more, and is still more preferably ten or more. Because it is sometimes difficult to make the specific resistance of the translucent conductive film 5.0 Ω·cm or less by adding small amount of conductive oxide acicular powder, when the average aspect ratio of the conductive oxide acicular powder is less than five.

Here, the average aspect ratio of the conductive oxide acicular powder and the average length mentioned below is obtained by the number average of powder.

Said conductive oxide acicular powder may be conductive oxide acicular powder with an average length of 5 to 20 micrometers, obtained by crushing the conductive oxide acicular powder having the average length of 25 micrometers or more and the average aspect ratio of five or more. If the conductive oxide acicular powder having undergone the above crushing treatment is used for translucent conductive coating liquid, the surface resistivity of the translucent conductive film obtained a little worsens, but the surface roughness (irregularity of the film surface) becomes smaller, which may be sometimes useful depending on the device to which the above-mentioned translucent conductive film is applied. For example, in the dispersive type EL device, about 100 V alternating voltage is applied to the phosphor layer (luminous layer) and the dielectric layer sandwiched by the transparent electrode and the back electrode, to let the light emitted. When above-mentioned translucent conductive film with small surface roughness is applied for the transparent electrode, it has an effect to suppress the short circuit between the electrodes and spark occurrence due to insulation breakdown, resulting from high protrusions on the transparent electrode. For an application to the dispersive type EL device with a small light emitting area, such as above-mentioned key input part (a keypad) of the cellular phone, the surface resistivity of the transparent electrode can be a higher value of about several kiloohms per square (kΩ/square), so that there is a tendency that the translucent conductive film which excels in the suppressive effect on an inter-electrode short circuit or on a insulation breakdown is preferred, despite its low surface resistivity.

For above-mentioned crushing treatment of the conductive oxide acicular powder, general-purpose crushing procedures, such as ultrasonic treatment, bead mill treatment, homogenizer treatment, and 3 roll mill treatment, can be used.

The ratio between the conductive oxide acicular powder and the binder in the translucent conductive film-forming coating liquid, expressed in the weight ratio (the conductive oxide acicular powder: the binder), is preferably (40:60) to (90:10), and still more preferably (50:50) to (70:30). The amount of the binder in the above-mentioned ratio between the conductive oxide acicular powder and the binder means the total sum of binder resin and curing agent components. If the proportion of the binder expressed in the weight ratio (the conductive oxide acicular powder: the binder) is more than (40:60), the resistance of the translucent conductive film obtained may become too high. And, if the proportion of the binder expressed in the weight ratio (the conductive oxide acicular powder: the binder) is less than (90:10), it can lead to unfavorable result that the strength of the translucent conductive film may be lowered, and at the same time acicular powders cannot well contact with each other, which may lead to high film resistance.

Solvents used for the translucent conductive film forming coating liquid, include, but are not limited to, for example: alcohol solvents, such as methanol (MA), ethanol (EA), 1-propanol (NPA), isopropanol (IPA), butanol, pentanol, benzyl alcohol, and diacetone alcohol (DAA); ketone solvents, such as acetone, methyl ethyl ketone (MEK), methyl propyl ketone, methyl isobutyl ketone (MIBK), cyclohexanone, and isophorone; glycol derivatives, such as ethylene glycol monomethyl ether (MCS), ethylene glycol monoethyl ether (ECS), ethylene glycol isopropyl ether (IPC), ethylene glycol monobutyl ether (BCS), ethylene glycol monoethyl ether acetate, ethylene glycol monobutyl ether acetate, propylene glycol methyl ether (PGM), propylene glycol ethyl ether (PE), propylene glycol methyl ether acetate (PGM-AC), propylene glycol ethyl ether acetate (PE-AC), diethylene glycol monomethyl ether, diethylene glycol monoethyl ether (carbitol), diethylene glycol monobutyl ether, diethylene glycol monomethyl ether acetate, diethylene glycol monoethyl ether acetate, diethylene glycol monobutyl ether acetate, diethylene glycol dimethyl ether, diethylene glycol diethyl ether, diethylene glycol dibutyl ether, dipropylene glycol monomethyl ether, dipropylene glycol monoethyl ether, and dipropylene glycol monobutyl ether; amines, such as formamide (FA), N-methylformamide, dimethylformamide (DMF), dimethylacetamide, and N-methyl-2-pyrrolidone (NMP); benzene derivatives, such as toluene, xylene, mesitylene, and dodecylbenzene; ethylene glycol, diethylene glycol, dimethylsulfoxide (DMSO), tetrahydrofuran (THF), and chloroform.

The solvent used for translucent conductive film forming coating liquid can be suitably selected taking into account the solubility of the plastic substrate used and the film formation conditions. For example, in the case of screen print, when evaporation rate, solubility of the emulsion for the plate and the binder resin, hazardous property, and the like are taken into account, ethylene glycol monobutyl ether acetate, diethylene glycol monoethyl ether, diethylene glycol monoethyl ether acetate, diethylene glycol monobutyl ether acetate, and the like, can be named as the preferable solvents.

Next, one preferable embodiment of the manufacturing method of the conductive oxide acicular powder, is described. First, indium metal is dissolved in nitric acid, the solution is heated with agitation, and is condensed at the solution temperature of 130 to 150° C. to form a thick slurry. After addition of a lot of water, this slurry is filtered, and the obtained acicular powder is washed, dried, calcinated for about 30 to 60 minutes at about several hundred degree centigrade, and acicular indium oxide powder is obtained. This acicular indium oxide powder is dispersed into water, and metallic salt solution of tin, zirconium zinc, tungsten, titanium, and the like are added, which leads to the formation of hydroxides of tin, zirconium, zinc, tungsten, titanium, and the like, on the surface and within the pores of the above-mentioned acicular indium oxide powder, by neutralization reaction. Solid is separated from liquid, and calcinated for about 30 to 60 minutes at about 700 to 1200° C. The above-mentioned hydroxide is converted into oxide by this calcination, and at the same time, changed to solid solution with indium oxide. Heat treatment (a treatment to lower the resistance by oxygen vacancy introduction) under a reducing atmosphere can be further performed if needed, and the conductive oxide acicular powder mainly consisting of indium oxide can be obtained.

This conductive oxide acicular powder has the average length of 5 micrometers or more and the average aspect ratio of five or more, and depending on concentration conditions, the one having the average length of about 5 to 200 micrometers and an the average aspect ratio of about 30, can be obtained (however, the ITO acicular powder with average length of 20 micrometers or less is not preferable from the cost aspect since it has low productivity in the above-mentioned manufacturing method, and is difficult to obtain, because it is not generally sold). A preferable powder shape from the aspect of the surface resistivity of the translucent conductive film has 20 to 100 micrometers length, and the aspect ratio of ten or more. Here, in the case of, for example, the acicular ITO powder doped with tin oxide, such a product can be obtained that, when formed into a pellet by pressure of 100 kgf/cm$^2$, has specific resistance (hereinafter, referred as compacted powder resistance) of about 0.01 to 0.03 Ω·cm.

The translucent conductive film forming coating liquid according to the present invention can be manufactured by mixing the above-mentioned conductive oxide acicular powder with the binder (consisting of the above-mentioned crosslinkable resin and the curing agent) and the solvent, adding a dispersant and performing dispersion processing, if needed. The binder may be added to the dispersion liquid of the conductive oxide acicular powder, or may be beforehand added to the solvent prior to dispersion of the conductive oxide acicular powder, without restriction in particular. General procedures, such as ultrasonic treatment, a homogenizer, a paint shaker, a bead mill, and a three-roll mill, are applicable to the dispersion processing.

The above-mentioned dispersants include various coupling agents such as a silicon coupling agent, various polymer dispersants, or various surface active agents of anion type, nonion type, cation type and the like. These dispersants may be added if needed, and they are suitably selected according to the kind of the conductive oxide acicular powder to be used and the dispersion processing method. Additives, such as defoaming agents and leveling agents may be added to improve the appearance of the coated film.

The translucent conductive film according to the present invention can be formed by printing or coating the above-mentioned translucent conductive film forming coating liquid on the substrate and then, heating to crosslink and cure the crosslinkable resin of the binder. For printing or coating the translucent conductive film forming coating liquid on the substrate, the screen printing, the gravure printing, the wire bar coating method, the doctor blade coating method, the roll coating method, and the like, can be used.

The above-mentioned substrate should be just transparent, and glass and various transparent plastics can be used as the substrate. As for the plastics, for example, polyethylene terephthalate (PET), polyethylene naphthalate (PEN), nylon, polyether sulfone (PES), triacetyl cellulose, norbornene resin, an acrylate resin, polycarbonate can be used. PET is a preferable material as the substrate from viewpoints of cheapness, excellence in strength, and also both transparency and flexibility. When using plastics for the above-mentioned substrate, adhesion treatment for increasing the adherence force with the transparent conductive film, specifically, plasma treatment, corona discharge treatment, short wavelength UV irradiation treatment, and the like can be performed beforehand.

The translucent conductive film according to the present invention obtained in this way has not only both high translucency and conductivity, but also contains the binder resin with high glass transition point, so that the translucent conductive film has excellent heat-resistant property. Therefore, for example, when the translucent conductive film is applied for the transparent electrode of the dispersive type EL device in the course of device manufacturing, deterioration of the film characteristics, such as the resistance of the translucent conductive film, is prevented, in the heat-treatment step at the time of each layer formation by lamination printing on the translucent conductive film. The specific resistance of the translucent conductive film is preferably 5.0 Ω·cm or less. This is because, when the specific resistance exceeds 5.0 Ω·cm, it becomes difficult to apply the translucent conductive film for the transparent electrode of the dispersive type EL device.

EXAMPLES

Hereafter, the present invention is specifically explained based on examples, but the present invention is not limited to these examples. In the following description, "%" indicates "% by weight", except for "%" of transmittance and haze value.

The transmittance (of visible light) and the haze value of the translucent conductive film were measured using the haze meter (HR-200) made by Murakami Color Research Laboratory. The surface resistivity of the translucent conductive film was measured using a surface resistivity meter LORESTA AP (MCP-T400) made by Mitsubishi Chemical Corporation. And, the viscosity of the translucent conductive film forming coating liquid was measured using the B-type viscometer, at 25° C. coating liquid temperature.

Example 1

As the conductive oxide acicular powder, ITO acicular powder made by Sumitomo Metal Mining Co., Ltd. (SCP-X700B; compacted powder resistance value: 0.05 Ω·cm, BET specific surface area: 8.9 $m^2/g$, average length: 31 micrometers, average aspect ratio: 8.4) was used. As binder resin, phenoxy resin (FX-293, made by Tohto Kasei Co. Ltd.,; Tg: 163° C., hydroxyl value: 163 KOH mg/g) was used, and as the curing agent thereof, HDI based blocked isocyanate (MF-K60X, made by Asahi Kasei Corporation, solid content (curing agent component): about 60%, the minimum curing temperature: 90° C.) was used. Ethylene glycol monobutyl ether acetate was used as a solvent.

The above-mentioned ITO acicular powder was mixed with the solvent containing the above-mentioned resin and curing agent to prepare a translucent conductive film-forming coating liquid. The composition of this translucent conductive film-forming coating liquid was; ITO: 33%, phenoxy resin: 14.8%, curing agent component: 3.1% and ethylene glycol monobutyl ether acetate: 49.1% (oxide acicular powder: binder components [binder resin +curing agent component] =65:35, NCO/OH =1/5.4). The viscosity (at 25° C.) of this translucent conductive film-forming coating liquid was 1500 mPa·s.

The above-mentioned translucent conductive film-forming coating liquid was screen-printed (using 200-mesh screen T200S, made by Tokyo Process Service Co., Ltd.) on the substrate, a PET film made by Toray Industries, Inc. (Lumirror, 100 micrometers thick, transmittance of 90%, and the haze value of 1.8%), heated for 20minutes at 120° C., and the translucent conductive film was formed.

Obtained translucent conductive film had transmittance (of visible light) of 77.8%, haze value of 87.5%, a surface resistivity of 2000 ohm per square (Ω/square), and specific resistance of 1.2 Ω·cm. The transmittance (of visible light) and the haze value of the translucent conductive film are values for only the translucent conductive film, and are calculated by the following formula, respectively.

Transmittance (%) of the translucent conductive film =(transmittance of the translucent conductive film together with the substrate)/(transmittance of the substrate)×100

Haze value (%) of the translucent conductive film =(haze value of the translucent conductive film together with the substrate)−(haze value of the substrate).

Next, the phosphor layer, the dielectric layer, and the back electrode were laminated in this sequence on the above-mentioned translucent conductive film to form a dispersive type EL device. The above-mentioned lamination of layers was carried out by screen-printing a phosphor paste, a dielectric paste, and a carbon paste, in which phosphor particles, dielectric particulates (barium titanate and the like), and carbon particulates, respectively, were dispersed in the solvent containing a binder (dried and cured at 130° C. for 30 minutes). The resistance value (surface resistivity) of the translucent conductive film after the dispersive type EL device formation was measured, and was compared with the resistance value (surface resistivity) before the dispersive type EL device formation. The results are shown in Table 1.

Example 2

A translucent conductive film forming coating liquid was prepared in the same way as in above-mentioned Example 1, except that polyether sulfone resin (RADEL A A-300A NT; Tg: 220° C., made by Solvay Advanced Polymers) which is not crosslinkable, was used as binder resin, the curing agent was not added, and N-methyl-2-pyrrolidone (NMP) was used as solvent. The composition of this translucent conductive film forming coating liquid was; ITO: 26%, polyether sulfone resin: 14.0%, and NMP: 60.0% (oxide acicular powder: binder component [binder resin]=65:35). The viscosity (at 25° C.) of this translucent conductive film forming coating liquid was 1000 mPa·s.

The above-mentioned translucent conductive film forming coating liquid was screen-printed (using 200-mesh screen T200S made by Tokyo Process Service Co., Ltd) on the substrate, a PET film made by Toray Industries, Inc. (Lumirror, 100 micrometers thick) in the same way as in Example 1, heated for 20 minutes at 120° C., and the translucent conductive film was formed.

The obtained translucent conductive film had transmittance (of visible light) of 77.0%, the haze value of 84.7%, the surface resistivity of 1000 Ω/square, and the specific resistance of 0.7 Ω·cm.

The dispersive type EL device was formed in the same way as in Example 1, and the resistance value (surface resistivity) of the translucent conductive film was measured. The results are shown in Table 1.

Example 3

A translucent conductive film forming coating liquid was prepared in the same way as in above-mentioned Example 1, except that a phenoxy resin having sulfur in its skeleton (resin obtained by heating and drying YPS-007 resin solution made by Tohto Kasei Co., Ltd.; Tg: 130° C., the hydroxyl value of 172 KOH mg/g) was used as binder resin, and that isophorone was used as solvent. The composition of this translucent conductive film forming coating liquid was; ITO: 31%, phenoxy resin: 16.1%, curing agent component: 0.5%, and isophorone: 52.4% (oxide acicular powder: binder component [binder resin+curing agent component]=65:35, NCO/OH=1/34.4). The viscosity (at 25° C.) of this translucent conductive film forming coating liquid was 3000 mPa·s.

The above-mentioned translucent conductive film forming coating liquid was screen-printed (using 200-mesh screen T200S made by Tokyo Process Service Co., Ltd.) on the substrate, a PET film made by Toray Industries, Inc. (Lumirror, 100 micrometers thick) in the same way as in Example 1, heated for 20 minutes at 120° C., and the translucent conductive film was formed.

The obtained translucent conductive film had transmittance (of visible light) of 76.7%, haze value of 87.2%, the surface resistivity of 1410 Ω/square, and the specific resistance of 0.99 Ω·cm.

The dispersive type EL device was formed in the same way as in Example 1, and the resistance value (surface resistivity) of the translucent conductive film was measured. The results are shown in Table 1.

Example 4

A translucent conductive film forming coating liquid was prepared in the same way as in above-mentioned Example 1, except that phenoxy resin containing phosphorus in the skeleton (resin obtained by heating and drying ERF-001 resin solution by Tohto Kasei Co., Ltd.; Tg: 146° C.; hydroxyl value: 166 KOH mg/g) was used as binder resin, and that diethylene glycol monoethyl ether (carbitol) was used as solvent. The composition of this translucent conductive film forming coating liquid was; ITO: 26%, phenoxy resin: 18.9%, curing agent component: 0.7%, and carbitol: 54.4% (oxide acicular powder: binder component [binder resin+curing agent component]=57:43, NCO/OH=1/33.2). The viscosity (at 25° C.) of this translucent conductive film forming coating liquid was 4000 mPa·s.

The above-mentioned translucent conductive film forming coating liquid was screen-printed (using 200-mesh screen T200S made by Tokyo Process Service Co., Ltd.) on the substrate, a PET film made by Toray Industries, Inc. (Lumirror, 100 micrometers thick) in the same way as in Example 1, heated for 20 minutes at 120° C., and the translucent conductive film was formed.

The obtained translucent conductive film had transmittance (of visible light) of 79.2%, the haze value of 89.3%, the surface resistivity of 792 Ω/square, and the specific resistance of 0.71 Ω·cm.

The dispersive type EL device was formed in the same way as in Example 1, and the resistance value (surface resistivity) of the translucent conductive film was measured. The results are shown in Table 1.

Example 5

A translucent conductive film forming coating liquid was prepared in the same way as in above-mentioned Example 4, except that ITO acicular powder with an average length of 12 micrometers obtained by crushing treatment of the ITO acicular powder made by Sumitomo Metal Mining Co., Ltd. (SCP-X700B; compacted powder resistance: 0.05 Ω·cm, BET specific surface area: 8.9 $m^2/g$, average length: 31 micrometers, average aspect ratio: 8.4) was used as conductive oxide acicular powder. The composition of this translucent conductive film forming coating liquid was; ITO: 33%, phenoxy resin: 13.7%, curing agent component: 0.5%, and carbitol: 52.8% (oxide acicular powder: binder component [binder resin+curing agent component]=70:30, NCO/OH=1/33.2). The viscosity (at 25° C.) of this translucent conductive film forming coating liquid was 1900 mPa·s.

The above-mentioned translucent conductive film forming coating liquid was screen-printed (using 200-mesh screen T200S, made by Tokyo Process Service Co., Ltd.) on the substrate, a PET film made by Toray Industries, Inc. (Lumirror, 100 micrometers thick) in the same way as in Example 4, heated for 20 minutes at 120° C., and the translucent conductive film was formed.

The obtained translucent conductive film had transmittance (of visible light) of 76.1%, the haze value of 90.0%, the surface resistivity of 950 Ω/square, and the specific resistance of 0.57 Ω·cm.

The dispersive type EL device was formed in the same way as in Example 4, and the resistance value (surface resistivity) of the translucent conductive film was measured. The results are shown in Table 1.

Comparative Example 1

A translucent conductive film forming coating liquid was prepared in the same way as in above-mentioned Example 1, except that the phenoxy resin (the resin obtained by heating and drying YP-50 resin solution by Tohto Kasei Co., Ltd.; Tg: 84° C.; hydroxyl value: 197 KOH mg/g) was used. The composition of this translucent conductive film forming coating liquid was; ITO: 35%, phenoxy resin: 7.9%, curing agent component: 10.9%, and ethylene glycol monobutyl ether acetate: 46.2%. (oxide acicular powder: binder component [binder resin+curing agent component]=65:35, NCO/OH=1/1). The viscosity (at 25° C.) of this translucent conductive film forming coating liquid was 1300 mPa·s.

The above-mentioned translucent conductive film forming coating liquid was screen-printed (using 200-mesh screen T200S made by Tokyo Process Service Co., Ltd.) on the substrate, a PET film made by Toray Industries, Inc. (Lumirror, 100 micrometers thick) in the same way as in Example 1, heated for 20 minutes at 120° C., and the translucent conductive film was formed.

The obtained translucent conductive film had transmittance (of visible light) of 78.9%, the haze value of 86.1%, the surface resistivity of 2500 Ω/square, and the specific resistance of 1.5 Ω·cm.

The dispersive type EL device was formed in the same way as in Example 1, and the resistance value (surface resistivity) of the translucent conductive film was measured. The results are shown in Table 1.

Comparative Example 2

A translucent conductive film forming coating liquid was prepared in the same way as in above-mentioned Example 1, except that an acrylic resin (Tg: 105° C.) not crosslinkable, was used as binder resin, and curing agent was not added. The composition of this translucent conductive film forming coating liquid was; ITO: 28%, acrylic resin: 18.7%, and ethylene glycol monobutyl ether acetate: 53.3%. (oxide acicular powder:binder component [binder resin]=60:40). The viscosity (at 25° C.) of this translucent conductive film forming coating liquid was 3000 mPa·s.

Next, this translucent conductive film forming coating liquid was screen-printed (using 200-mesh screen T200S, made by Tokyo Process Service Co., Ltd.) on the substrate, a PET film made by Toray Industries, Inc. (Lumirror, 100 micrometers thick) in the same way as in Example 1, heated for 20 minutes at 120° C., and the translucent conductive film was formed.

Obtained translucent conductive film had transmittance (of visible light) of 79.2%, the haze value of 84.4%, the surface resistivity of 2100 Ω/square, and the specific resistance of 1.26 Ω·cm.

The dispersive type EL device was formed in the same way as in Example 1, and the resistance value (surface resistivity) of the translucent conductive film was measured. The results are shown in Table 1.

TABLE 1

Changes in resistance values (surface resistivity) of before and after dispersive type EL device formation

| | transmittance (%) | Haze (%) | Surface resistivity (Ω/square) Before device formation | Surface resistivity (Ω/square) After device formation | Specific resistance (Ω · cm) (Note 1) | Binder resin Type of resin | Binder resin Glass transition temperature (Tg) |
|---|---|---|---|---|---|---|---|
| Example 1 | 77.8 | 87.5 | 2000 | 2200 | 1.2 | Phenoxy | 163° C. |
| Example 2 | 77.0 | 84.7 | 1000 | 1020 | 0.7 | Polyether Sulfone | 220° C. |
| Example 3 | 76.7 | 87.2 | 1410 | 2650 | 0.99 | Phenoxy | 130° C. |
| Example 4 | 79.2 | 89.3 | 792 | 782 | 0.71 | Phenoxy | 146° C. |
| Example 5 | 76.1 | 90.0 | 950 | 970 | 0.57 | Phenoxy | 146° C. |
| Comparative example 1 | 78.9 | 86.1 | 2500 | 150000 | 1.5 | Phenoxy | 84° C. |
| Comparative example 2 | 79.2 | 84.4 | 2100 | 10000 | 1.26 | Acrylic | 105° C. |

(Note 1) specific resistance (Ω · cm) = surface resistivity (Ω/square) × thickness (cm)

Surface roughness (irregularity) assessment of translucent conductive film

The surface roughness (irregularity) of the translucent conductive film according to each of Examples of the present invention and Comparative examples was estimated by the film surface observation (area of 0.5 millimeter×0.5 millimeter) by a laser microscope. In any translucent conductive film of Examples 1 to 4 and Comparative examples 1 and 2, the surface roughness (Ra) was about 2 micrometers, and the maximum height of the protrusion (the thickness at the portion with the highest protrusion—average thickness) was 4 to 5 micrometers. On the other hand, in the translucent conductive film of Example 5 utilizing crushed conductive oxide acicular powder, the surface roughness (Ra) was about 1 micrometer, and the maximum height of the protrusion (the thickness at the portion with the highest protrusion—the average thickness) was about 2 micrometers.

Results

By comparing Examples 1 to 4 with Comparative examples 1 and 2, it is seen that an increase of the resistance value (surface resistivity) of the translucent conductive film upon dispersive type EL device formation, can be suppressed by using the resin having a high glass transition point for binder.

In addition, the surface roughness (the irregularity of the film surface) of the translucent conductive film is small in Example 5, which has a depressive effect on the generation of an inter-electrode short circuit and the spark occurrence by insulation breakdown of the dispersive type EL device. That makes the degree of freedom of the structural design of the dispersive type EL device larger, and, in parallel, is also useful for improving the production yield of the dispersive type EL device.

Industrial Applicability

As described above, the translucent conductive film forming coating liquid according to the present invention has a great industrial usefulness, since it has high translucency and outstanding conductivity, and at the same time, when it is applied for a transparent electrode etc. of the dispersive type EL device, deterioration of film characteristics, such as the resistance value, can be suppressed in the production process of the dispersive type EL device.

What is claimed is:

1. A dispersive type electroluminescent device which comprises:

a substrate, a translucent conductive film as an electrode on said substrate, said film being formed from a translucent conductive film-forming coating liquid comprising conductive oxide acicular powder dispersed in a solvent containing binder resin and curing agent, a weight ratio of said conductive oxide acicular powder to binder provided by said binder resin and said curing agent being between 40:60 and 90:10, said binder resin being phenoxy resin having at least one of phosphorus and sulfur in a skeleton thereof and a glass transition point (Tg) of 130° C. or higher, said translucent conductive film having a specific resistance of 5.0 Ω·cm or less, and a phosphor layer over said translucent conductive film.

2. The dispersive electroluminescent device according to claim 1, wherein the glass transition point (Tg) of said binder resin is 140° C. or higher.

3. The dispersive electroluminescent device according to claim 1, wherein said curing agent is blocked isocyanate.

4. The dispersive electroluminescent device according to claim 1, wherein said conductive oxide acicular powder is mainly composed of at least one metallic oxide selected from the group consisting of indium oxide, tin oxide, and zinc oxide.

5. The dispersive electroluminescent device according to claim 1, wherein said conductive oxide acicular powder is indium oxide doped with at least one metallic oxide selected from the group consisting of tin oxide, zirconium oxide, zinc oxide, tungsten oxide, and titanium oxide.

6. The dispersive electroluminescent device according to claim 1, wherein the average aspect ratio of said conductive oxide acicular powder is five or more.

7. The dispersive electroluminescent device according to claim 1, wherein said conductive oxide acicular powder has average length of 5 to 20 micrometers obtained by crushing the conductive oxide acicular powder with the average length of 25 micrometers or more and with the average aspect ratio of five or more.

8. The dispersive electroluminescent device according to claim 1, wherein said phenoxy resin is selected from the group consisting of a bisphenol compound and epichlorohydrin.

9. The dispersive electroluminescent device according to claim 8, wherein said phenoxy resin is a bisphenol compound selected from the group consisting of bisphenol A, bisphenol B, bisphenol C, bisphenol D, bisphenol E and bisphenol F.

10. The dispersive electroluminescent device according to claim 9, wherein said phenoxy resin consists of a mixture of bisphenol A and bisphenol.

* * * * *